US009889912B2

(12) United States Patent
Habeger

(10) Patent No.: US 9,889,912 B2
(45) Date of Patent: Feb. 13, 2018

(54) SUBMERSIBLE REMOTE CONTROLLED VEHICLE

(71) Applicant: New Wave Technologies, LLC, Big Lake, MN (US)

(72) Inventor: Cam Habeger, Big Lake, MN (US)

(73) Assignee: New Wave Technologies, LLC, Big Lake, MN (US)

( * ) Notice: Subject to any disclaimer, the term of this patent is extended or adjusted under 35 U.S.C. 154(b) by 0 days.

(21) Appl. No.: 15/681,354

(22) Filed: Aug. 19, 2017

(65) Prior Publication Data

US 2017/0349250 A1 Dec. 7, 2017

Related U.S. Application Data

(63) Continuation of application No. 14/814,505, filed on Jul. 30, 2015, now Pat. No. 9,738,360.

(60) Provisional application No. 62/107,436, filed on Jan. 25, 2015.

(51) Int. Cl.

| | |
|---|---|
| ***B63G 8/00*** | (2006.01) |
| ***B63G 8/20*** | (2006.01) |
| ***B63C 11/52*** | (2006.01) |
| ***B63G 8/38*** | (2006.01) |

(52) U.S. Cl.

CPC ..... *B63G 8/001* (2013.01); *B63C 11/52* (2013.01); *B63G 8/20* (2013.01); *B63G 8/38* (2013.01); *B63G 2008/007* (2013.01)

(58) Field of Classification Search

None

See application file for complete search history.

(56) References Cited

U.S. PATENT DOCUMENTS

| | | | | |
|---|---|---|---|---|
| 6,122,852 | A * | 9/2000 | Mechling, IV | A01K 97/01 43/26.1 |
| 6,822,927 | B1 * | 11/2004 | Holm | A01K 97/01 367/107 |
| 7,017,911 | B1 * | 3/2006 | Chia | A63H 23/08 273/442 |
| 9,227,709 | B1 * | 1/2016 | Schill | B63G 8/16 |
| 2002/0083880 | A1 * | 7/2002 | Shelton | B63G 8/001 114/312 |
| 2012/0275864 | A1 * | 11/2012 | Valade | B63G 8/001 405/154.1 |

* cited by examiner

*Primary Examiner* — James M McPherson

(74) *Attorney, Agent, or Firm* — Damian Wasserbauer, Esq.; Wasserbauer Law LLC

(57) ABSTRACT

An method for ice fishing using a submersible vehicle assembly and underwater powered observation system using a camera and source of light of a green laser to be directed to the underside of ice so as to locate the vehicle assembly and allow the user to cut a hole in the ice at or near fish. In this manner the vehicle assembly may be utilized for the underwater tasks of locating fish and/or observing fish under the ice. Additional features include identifying water temperature and depth information that may be displayed on the control unit, a hydrophobic coating preventing ice buildup, and a stand adaptable for resting on the bottom during use.

2 Claims, 5 Drawing Sheets

SUBMERSIBLE REMOTE CONTROLLED VEHICLE

This application is a continuation of and claims the benefit of U.S. Non-Provisional application Ser. No. 14/814,505 filed Jul. 30, 2015 and U.S. Provisional patent Application No. 62/107,436, filed Jan. 25, 2015, which are incorporated herein.

FIELD OF THE INVENTION

The present invention relates to a remotely controlled underwater observation apparatus and system that is specifically designed within a miniature frame with specific vertical drives so it can navigate through small areas with stable propulsion.

BACKGROUND OF THE INVENTION

The term Remote Operated Vehicle (ROV) refers to different kinds of vehicles and devices that may be used for underwater exploration or recovery of objects and things. The principal aspect of the design of any ROV is its size. Commercial large ROVs are impractical for recreational use because of such disadvantages of size and cost. For example, conventional large commercial ROV's for inspection and recovery are typically operated from a ship and require hoists, generators and personnel to operate. Commercial medium sized ROVs units are known and may be used for rescue and recovery by Fire Departments and professionals. Here again, these commercial ROVs of a medium size require equipment (i.e. energy generators to supply power through large cables), personnel (i.e. multiple people to operate) and are costly to purchase and maintain. As a result, large and medium size ROV's units have limited practical recreational use because of their size, cost and other disadvantages.

Known recreational ROVs for recreational use also have disadvantages of size and cost. Recreational ROV systems, because of their size and required auxiliary equipment, typically require more than one person to transport, set up and operate. Recreational ROV systems typically comprise a submersible unit that is controlled and powered by a generator or other source through a connecting cable that transmits the power and control signals from the topside to the underwater vehicle. The underwater vehicle typically has a propulsion system to be able to maneuver and a camera system to feed images for observation back to a monitor. Efforts to reduce the size and cost of recreational ROVs result in eliminating functionality and features. As a result, there is a long-felt need for a miniature ROV with improved maneuverability by a single person without eliminating functionality and features related to transmitting power, operation and navigating.

Examples of submersible ROV's include an ROV with cameras that return images to a control unit on the surface and operating submarine toys. Representative examples of such submersible recreational vehicles generally have a construction with a neutrally buoyant miniature frame and propulsion as is illustrated in U.S. Pat. No. 3,101,066 to A. Haselton, U.S. Pat. No. 4,919,637 to Fleischmann, U.S. Pat. No. 6,662,742 to Shelton et al., U.S. Pat. No. 6,822,927 to Holm, U.S. Pat. No. 6,986,320 to Shelton et al., U.S. Pat. No. 7,441,509 to Piska, U.S. Pat. No. 7,707,958 to Hawkes, and U.S. Pat. No. 8,585,451 to Bleicken. Some submersible recreational vehicles have a communication means linking the base unit with the on-board control electronics in the underwater vehicle as is illustrated in U.S. Pat. No. 4,919,637 to Fleischmann, U.S. Pat. No. 7,540,255 to Hawkes and U.S. Pat. No. 7,707,958 to Hawkes. While suitable for novelty, the known prior art suffers disadvantages of difficulty to operate, not having the control and battery in submersible ROV unit and limited camera visibility.

Of the submersible ROVs having application in the recreational activity of fishing, such conventional ROVs are designed for moving fishing lures away from holes and persons so as not to be detected by the fish. For example, in U.S. Pat. Nos. 6,122,852, 6,822,927, and 7,441,509 designs of ROVs for moving fishing lures, specifically away from an ice hole, have an attachment for the fishing lure and pull the fishing line as they are moving away from the ice hole and then when a fish bites the line releases from the ROV. Ice fishing ROVs are propelled through the water by spiked wheels that obtain their driving force from running against the bottom of the ice or from standard propellers. Ice fishing ROVs are positioned and maneuvered using motorized systems with minimal controls and feedback. Ice fishing ROVs may include sensors (e.g. transducers with monitor 28s) that can show if fish are present and water depth. However, known ice fishing ROVs have disadvantages as these do not have cameras or video monitors, have limited power, maneuverability and duration. As a result, there is a long-felt need for a fishing ROV with improved maneuverability, transmitting power, operation, navigation and the ability to provide images of the ice fishing area and/or fish.

Moreover, in the general activity of fishing, and/or recreational water use, there is a long-felt need for an ROV with full capabilities, features and functionality to perform all of the tasks of the larger units like boat hull and drives inspections, looking for lost items, fresh and salt water fishing, search for persons who might have drowned, inspect nets and traps for fish, crabs or lobster, observe bridge and pier conditions and construction, oil rig footing inspections, and especially ice fishing as mentioned above. There also is a need for an ROV system made adaptable to the task with additional accessories like a hook or motorized clamp for retrieval of various items.

SUMMARY OF THE INVENTION

It is an object of the present invention to provide a system for use in ice fishing using a vehicle assembly configured to be submersible in a water environment and adapted with a camera and a source of light for locating said vehicle assembly under the ice. The vehicle assembly has a source of electrical power disposed in a waterproof enclosure and a vehicle control circuit operably coupled thereto with a charging circuit adapted to charge the source of electrical power without opening the waterproof enclosure. The vehicle control circuit is configured with a processor for receiving camera images, sensor information, and for controlling lights, and the movement of the vehicle assembly using the propulsion system. A magnetic reed switch advantageously is used to open and close a charging circuit so as to charge the vehicle battery when in the waterproof enclosure. A control unit is operably coupled to the vehicle control circuit for controlling the vehicle assembly in the underwater conditions. The control unit has a display to display camera images of the underwater location and to operate the vehicle assembly using one or more directional inputs so as to control the propulsion system in neutral buoyancy, vertical and horizontal directions.

Such features and functions are important for modern recreational ROVs and especially in the application of navigating an underwater camera for recreational use, for example, in ice fishing under the ice.

The following Drawings and Detailed Description will further define the advantages of this invention and provide more understanding of the unique embodiments and features of this system

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein.

DESCRIPTION OF THE EMBODIMENTS

Figure 1:
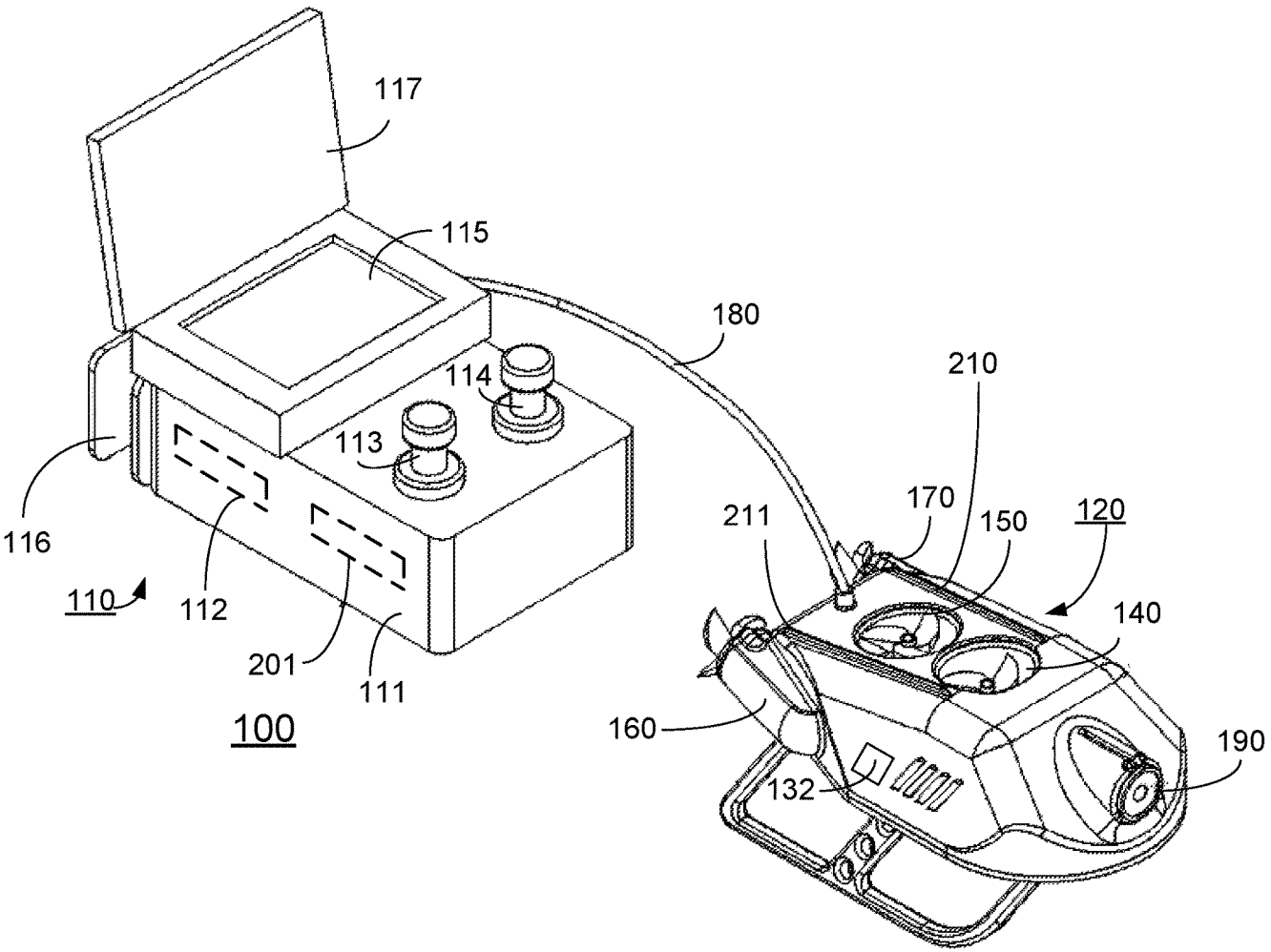
FIG. 1 is a schematic view illustrating a ROV and system in accordance with an embodiment of the present invention.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art can select from these or their equivalent in view of the disclosure herein and use of the term "means" is not intended to be limiting.

As used herein the term "vehicle" or "Remote Operated Vehicle" "ROV" refers to a vehicle controlled by an operator who is not in the vehicle such as by radio control, light control, sound control, or through a cable or line connecting the vehicle to the operator's location.

Figure 2:
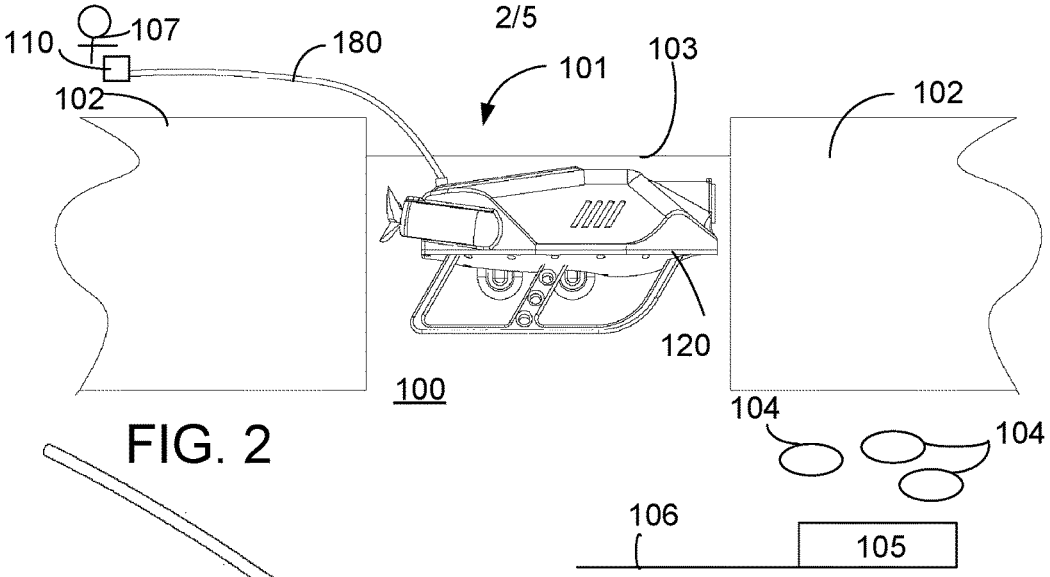
FIG. 2 is a cross-sectional view illustrating the ROV and system descending down thru the ice hole in accordance with an embodiment the present invention.

As is illustrated in FIGS. 1 through 10, a Remote Operated Vehicle (ROV) and system is generally described by element 100. Throughout the following description, the ROV 100 is described in an embodiment for recreational fishing and, more particularly, for the activity of ice fishing. In the ice fishing activity, as is illustrated in FIG. 2, a hole 101 is cut into the ice 102 body of water 103 and the ROV 100 is adapted to pass through the hole 101 to search for fish 104 by travelling to location 105 in the water 103. The ROV 100 may sit on the bottom 106 of and transmit images of fish 104 back to the user 107. In a preferred embodiment, once the fish 104 and/or desired location 105 is located, the ROV 100 can transmit its location to the ice 102 and user 107 on the surface can observe where there are fish 104. However, it is appreciated by one skilled in the art that the ROV 100 has many uses and is not specifically limited and may be utilized for other recreational activities including search and rescue, treasure hunting, general curiosity and interest, finding lost objects, undersea investigation, fish watching, and the like.

As is illustrated in FIG. 1, the ROV and system 100 generally comprises a control unit 110 and a vehicle assembly 120. The control unit 110 may be formed with a rugged enclosure 111 sufficient to house and protect an electronic circuit board 112 used to maneuver the vehicle assembly 120 as is described herein. The control unit 110 may further include one or more joysticks 113, 114 adapted to provide input from the user 107 for maneuvering the vehicle assembly 120 in the water 103. The control unit 110 may further be configured with a display 115 adapted to display images from the vehicle assembly 120 in the water 103. The enclosure 111 of the control unit 110 may be formed on one or more parts. The enclosure may be formed waterproof to eliminate failures from environmental factors with an opening adapted to allow the cable 180 to reach electronic circuit board 112 allowing it to transmit and receive signals between the control unit 110 to the vehicle assembly 120 to accomplish maneuvering the vehicle assembly 120, to visualize the underwater environment, and for other purposes of the invention. The enclosure 111 of the control unit 110 may also be formed with a spooling cradle 116 so that the cable assembly 180 may advantageously be wound around and spooled for transporting the ROV and system 100. Finally, the control unit 110 may include a cover 117 adapted to cover and protect the display 115, and in an alternative embodiment, the joystick 113, 114 when transporting the ROV and system 100.

Figure 3:
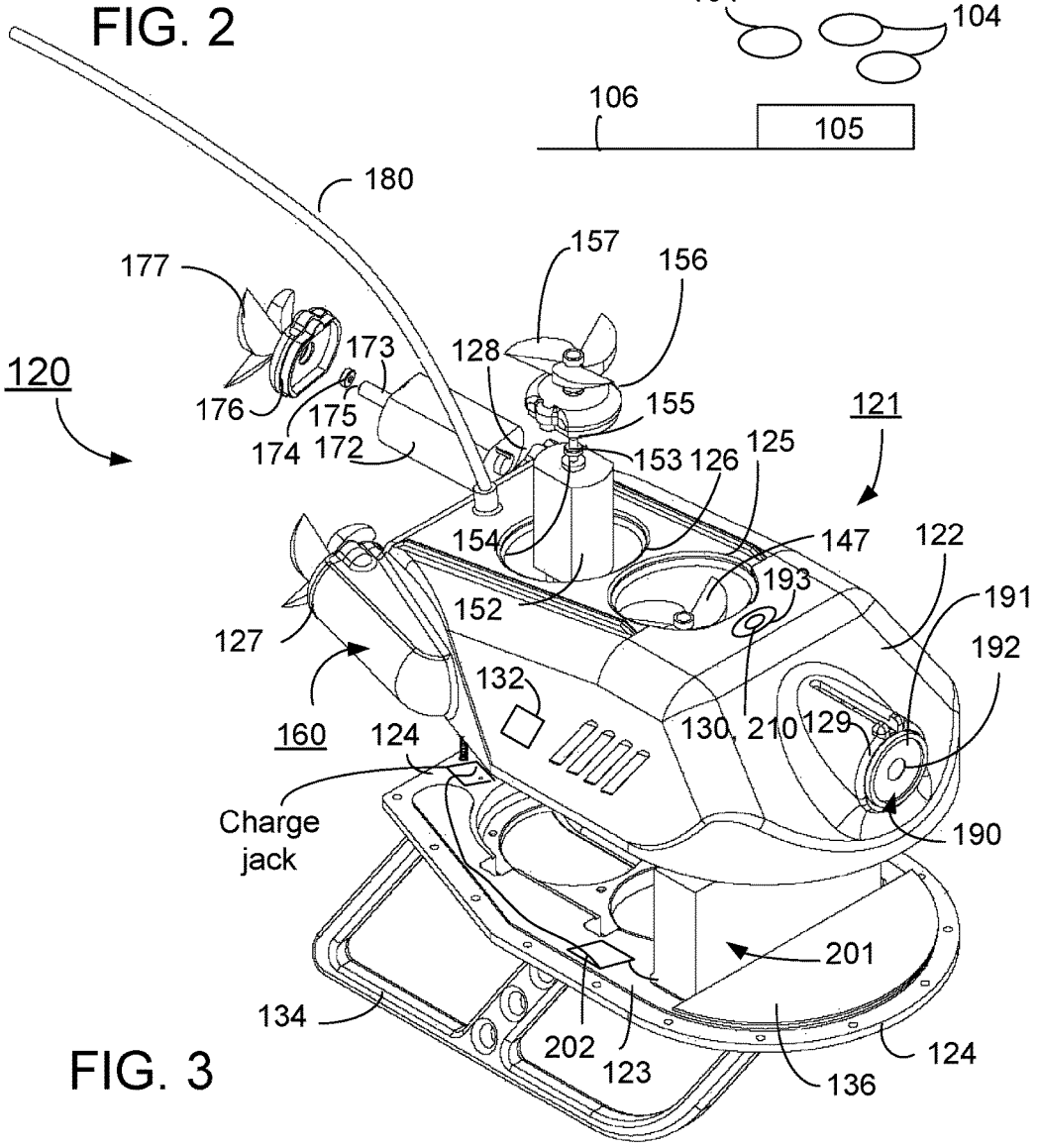
FIG. 3 is a perspective partially expanded view illustrating the ROV and system of the present invention.
Figure 8:
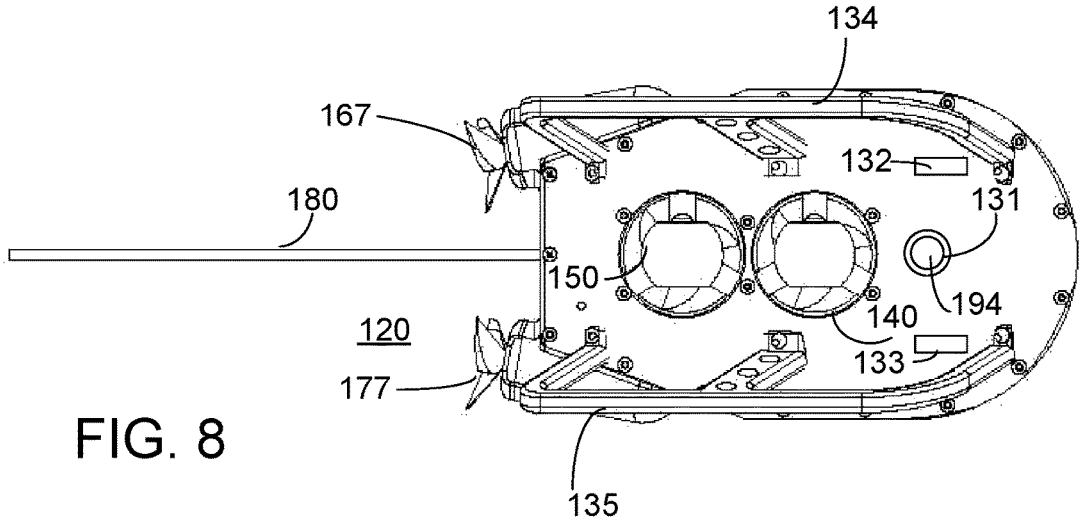
FIG. 8 is a bottom view illustrating the ROV and system of the present invention.

Referring to FIGS. 1, 3 and 8, the vehicle assembly 120 may comprise an enclosure 121 configured in an upper portion 122 and lower portion 123 joined and made waterproof at a mid-portion by seal 124. The enclosure 121 may be formed with a vertical forward center opening 125 and a vertical aft center opening 126 located along a longitudinal center of gravity and/or centerline of the enclosure 121 for housing the vertical propulsion system 140, 150 as described herein. Enclosure 121 may also be formed with a starboard outer opening 127 and a port outer opening 128 located on the yawl axis of the enclosure 121 for housing the horizontal propulsion system 160, 170 as described herein. The enclosure 121 further may be configured with a forward opening 129 and one or more upper opening(s) 130 and lower opening(s) 131. The forward opening 129 is configured to receive a camera assembly 190 as described herein for providing images to the control unit 110 regarding the underwater 103 conditions, fish 104 and optimal location 105 such as, for example, the recreational activity of ice fishing. The upper opening 130 may be used for an upper camera 193 so as to observe and visualize upward information relative to the vehicle assembly 120 when in the water 103. The upper opening 130 may be used for a laser assembly 210 that is used to locate the vehicle assembly 120 when in the water 103 and under the ice 102 so as to locate an optimum location 105 for ice fishing. The laser of the ROV 120 can be projected to the ice and/or surface to provide a location of vehicle assembly 120 as well as, for example, a desired location to drill a hole 101 in an ice fishing application. The lower portion 123 of the enclosure 121 may further include lower openings 131, 132, 133 that are adapted to receive a lower camera 194, a light 220 or pockets 132, 133 for ballast weight(s).

Referring to FIGS. 1 through 8, the upper portion 122 of the ROV and system 100 may be configured with a body shape of a smooth design is formed to hold the camera assembly 190, the vertical propulsion systems 140, 150, the horizontal propulsion systems 160, 170, and the laser 210. The upper portion 122 may be formed by an injection molded plastic formed to have the openings for the motors of the vertical thrusters, for example, the vertical forward center opening 125, vertical aft center opening 126, and forward opening 130 as well as horizontal thrusters 160, 170 in starboard outer opening 127 and port outer opening 128. In an alternative embodiment the upper portion 122 may include an upper opening 130 for an alternative upper facing camera 193.

The upper portion 122 of the enclosure 121 may be configured to be attached and sealed to the lower portion 123 by the seal 124. The upper portion 122 can be configured to hold the horizontal thrusters 160, 170 in starboard outer opening 127 and port outer opening 128. Similarly the lower portion 123 may be formed with a body shape of a smooth design. The lower portion 123 the electrical circuit board 136, legs 134, 135 and battery 201 (as described herein). The legs 134, 135 which can be molded on or designed to snap into the lower portion 123 of the enclosure 121. In an alternative embodiment the lower portion 123 may include a lower opening 131 for an alternative lower facing camera 194.

The legs 134, 135 allow the vehicle assembly 120 of the ROV and system 100 to sit at a location 105 on the bottom 106 without ingesting debris or to simply observe the environment or fish 104 in one place. Alternatively, the design of the legs 134, 135 can be modified if the horizontal thrusters 160, 170 are moved further to the outside of the vehicle assembly 120 of the ROV and system 100. The horizontal thrusters 160, 170 may be configured and moved further outboard or on centerline to increase the stability of the vehicle assembly 120 such as, for example for environmental conditions of use including a strong currents, rocky bottom 106, plants and other considerations. The lower portion 123 may be formed with one or more pockets 132, 133 to hold small weights added to either side or in the front or rear of the vehicle assembly 120 in order to balance, float flat or to change the buoyancy when moving from fresh to salt water the vehicle assembly 120 of the ROV and system 100. The goal is to have a neutrally buoyant vehicle assembly 120 neither move up or down in the water 103 unless driven up or down by the vertical thrusters 140, 150.

The ROV and system 100 may be configured to have propulsion means such as vertical thrusters configured as a forward vertical propulsion system 140 and an aft vertical propulsion system 150 and starboard horizontal propulsion system 160 and port horizontal propulsion system 170 powered by a source of electrical power 200 such as, for example, an on board rechargeable battery 201 as a source of electrical power. As in the vehicle assembly 120 of the ROV and system 100 is made waterproof, the enclosure 121 is adapted to receive the battery 201 for ease of recharging the system 100. The battery 201 may be formed as a sealed battery. The electrical circuit board 136 of the vehicle assembly 120 may also be sealed in the an enclosure 121 between the upper portion 122 and lower portion 123 utilizing the seal 124 so as to be not affected by water 103. Moreover, the battery is positioned slightly forward of the center of gravity of the vehicle assembly 120. As the battery 201 has a predetermined weight, the balance and buoyancy of the vehicle assembly 120 is configured to utilize the battery in the forward position as well as to balance the weight of other compliments such as, for example, the motors 142, 152, 162, and 172.

Figure 6:
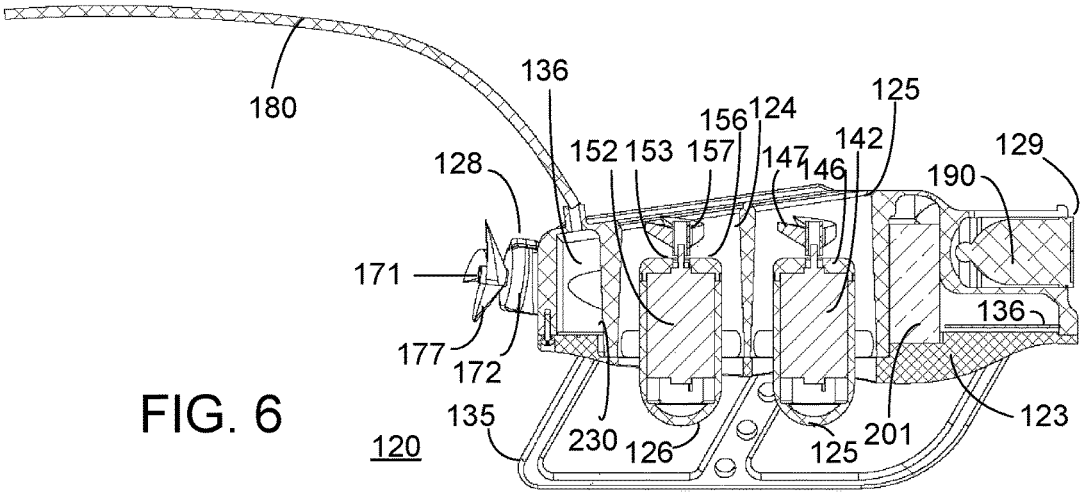
FIG. 6 is a cross-sectional view, taken along lines A-A of FIG. 5, illustrating the ROV in accordance with the present invention.
Figure 9:
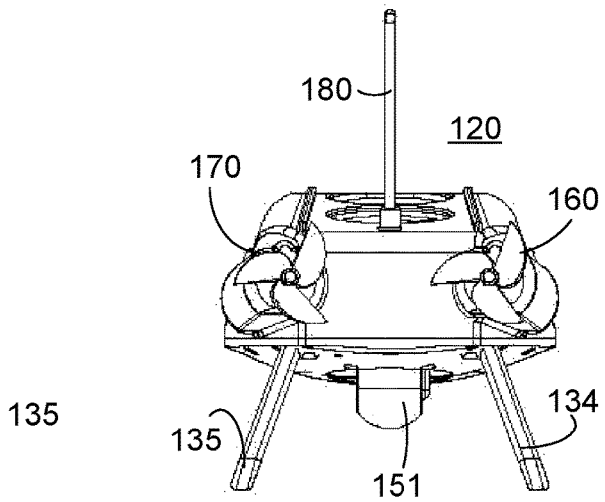
FIG. 9 is a rear view illustrating the ROV and system of the present invention.
Figure 10:
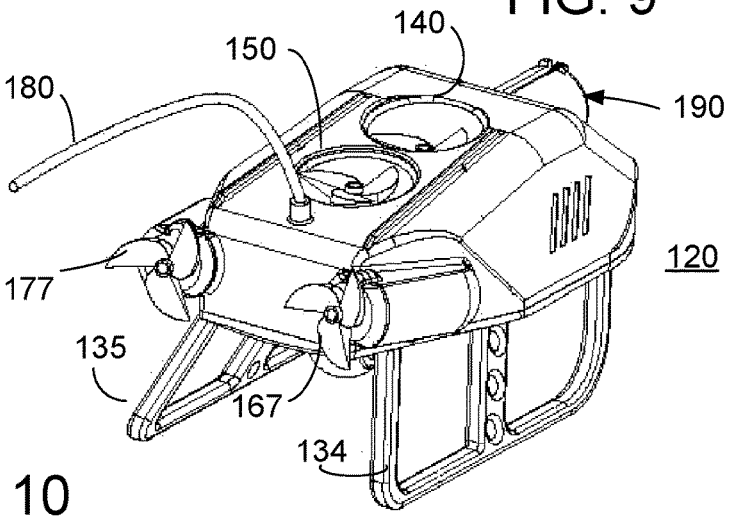
FIG. 10 is a rear perspective view illustrating the ROV of the present invention

Referring to FIGS. 1, 3, 4, 6, 8, 9 and 10 the forward vertical propulsion system 140 and aft vertical propulsion system 150 and starboard horizontal propulsion system 160 and port horizontal propulsion system 170 can be configured to be operably coupled to the propellers 147, 157, 167 and 177. According to an embodiment of the present invention, an important design is to have counter-rotating drives with left and right screws for straight propulsion. According to an embodiment of the present invention, propellers 147 and 177 are left screws providing counter clockwise rotation and propellers 157 and 167 are right screws providing clockwise rotation. FIGS. 9 and 10 show the various components of the miniature assembly. Referring to FIG. 6, horizontal and vertical thrusters 140, 150 may be formed to be located in the vertical forward and aft center openings 125, 126, respectively, molded in the upper and lower portions 122, 123 of the enclosure 121. Any wires or lines for the motors 142, and 152 are inserted and pulled through, for example, a small hole formed in the forward vertical spoke 137 and aft vertical spoke 138 that are sealed in a later manufacturing step with such wires for the motors 142, 152 are operably connected to the circuit board assembly 136. After the motors 142, 152 are inserted in the vertical forward and aft center openings 125, 126, respectively, the end caps 146, 156 with special shaft seals 144, 154 are sealing the motor assembly to the top of the end caps 146, 156 to create a water proof enclosure for the motors 142, 152. In an alternate construction, the motors 142, 152 may be encapsulated with oil or a similar solution to fill the motor cavity so as to repel and keep the water 103 out of the motor cavity. According to an embodiment of the present invention, the seals 144, 154 (and 164, 174) for the shafts 143, 153 (and 163, 173) are designed for the higher shaft speeds and for sealing at higher pressures at lower depths.

Referring to FIG. 10, the right horizontal propeller 167 provides forward thrust when turning clockwise and the left horizontal propeller 177 provides forward thrust when turning counter-clockwise, thereby providing a balancing effect and prevents the direction of propellers 147, 157, 167, 177 from inducing a rotational force to the vehicle assembly 120. Similarly, the front vertical propeller 147 provides thrust when turning counter-clockwise and the rear vertical propeller 157 provides thrust when turning clockwise. All propellers 147, 157, 167, 177 provide propulsion in forward and reverse directions according to commands provided by the control unit 110 for the appropriate direction, clockwise and counter-clockwise rotation, when maneuvering the vehicle assembly 120.

According to another important aspect of an embodiment of the present invention, the vertical propellers 147 and 157 of the dual counter-rotating thrusters 140, 150 are located on the centerline of the vehicle assembly 120 of the ROV and system 100. The vertical propellers 147 and 157 of the dual counter-rotating thrusters 140, 150 are also located close to the center of gravity to provide a straight non-rotating vertical travel which is unique to the design of the present invention. The vertical thrusters 140, 150 can be of the same rotation and screw design. Alternatively, the vertical thrusters 140, 150 may be located on the sides away from the center of the vehicle assembly 120, with appropriate modifications for manufacturing misalignment, variation in motor speed, propeller pitch variations, or other external influences may introduce yaw and control problems to the vehicle assembly 120 of the ROV and system 100. As a result, the design of the vehicle assembly 120 dual vertical thrusters 140, 150 can also be separated and moved further forward and backward along the centerline so as to effectuate different vertical propulsion or further positioning of the thrusters at an upward or downward angle for improved observation of items like boat hulls or underwater structure.

According to another important aspect of an embodiment of the present invention, the forward vertical propulsion system 140 and aft vertical propulsion system 150 and starboard horizontal propulsion system 160 and port horizontal propulsion system 170 can be configured to with gyroscopic balance integrated into said vehicle control circuit. The gyroscopic balance advantageously may be formed to control the horizontal direction, vertical direction and neutral balance of the vehicle assembly 120 in the underwater environment. As a result, the design of the propulsion system thrusters 140, 150, 160 and 170 of the vehicle assembly 120 can be coordinated for improved operation in the underwater environment such as, for example, descending ice holes, adjustment for currents, attitude control, location control, and positioning when viewing fish or other items like boat hulls or underwater structure.

Figure 7:
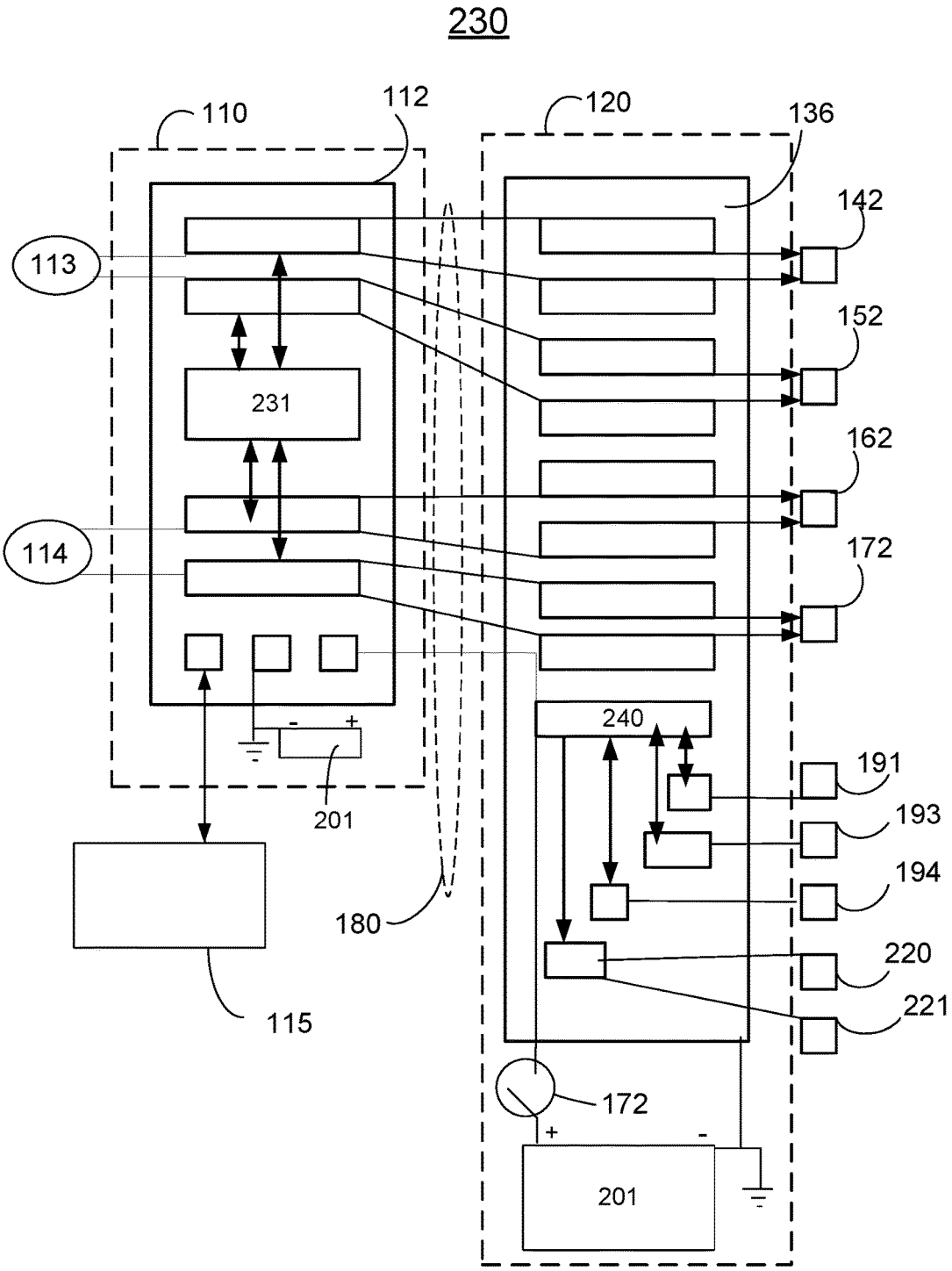
FIG. 7 is a circuit diagram illustrating the ROV and system in accordance with the present invention

The vehicle assembly 120 is configured to house battery 201 that is a source of electrical power 200 as is illustrated in FIGS. 3 and 6. The control unit 110 may be formed with a battery 201 in addition to the battery located on the vehicle assembly 120 as is illustrated in FIGS. 1 and 7. According to an embodiment of the present invention, it is advantageous that the battery 201 as the source of electrical power 200 is located on-board the vehicle assembly 120 so as to provide sustained use underwater 103 the ROV and system 100 thereby improving range, operating time, and other functions and features that are not found in other recreational remote operating vehicles of this size and operational use. The battery 201 may be configured in a high-capacity rechargeable battery such as, for example, a lithium ion battery. Advantageously, the vehicle assembly 120 includes a magnetic reed switch 202 to complete the circuit or open the circuit for charging of the battery 201. The magnetic reed switch 202 may be formed from a reactive switch from a ferrous-reed construction. The magnetic reed switch 202 may be configured to open and close the reed switch when a magnet is positioned close to the bottom of the enclosure 121 so as to close the circuit i.e. charging circuit. In operation, when the magnet is removed magnetic reed switch 202 opens the circuit and to allow the charging (battery leads) to be essentially off during the submersion of the ROV 120 in water 103. The magnetic reed switch 202 advantageously eliminates any bleed of electricity into the water 103 as well as allowing the rapid charging of the on-board battery of the ROV 120 which is heretofore not been possible with current induction charging methods.

The ROV and system 100 also has an electronic circuit board 112 located in the control unit 110 as well as an electronic circuit board 136 located in the vehicle assembly 120 that are coupled by communication using cable 180 communicating input and output signals between these two circuit boards 112, 136 so as to form a vehicle control circuit 230 as shown in FIG. 7. Each circuit board assembly 112, 136 comprises micro-processor controls and associated electronics to direct the electrical power to the horizontal and vertical motors 142, 152 and 162, 172, respectively, so as to power the propellers 147, 157, 167 and 177 and to communicate control so as to turn independently and at varying rates of rotation by the user operating and controlling the vehicle assembly 120 using the joysticks 113, 114 of the control unit 110.

Referring to FIGS. 1 and 7, the joysticks 113, 114 are useful to control movement of the vehicle assembly 120 in the water 103. For example, joystick 113 may be configured to operate the propulsion systems 140, 150 so as to control the vertical dimension and movement of the vehicle assembly 120. According to one embodiment of the present invention, the propeller 147 is pitched for clockwise rotation and propeller 157 is pitched for counter-clockwise rotation, thereby providing balancing and stability to the vehicle assembly 120. Movement of the joystick 113 is adapted to vary the current supplied to the motors 142 and 152 so as to create movement in the vertical direction.

Similarly, joystick 114 may be configured to operate the propulsion system 160, 170 so as to control the horizontal dimension and movement of the vehicle assembly 120 through the water 103. For example, joystick 114 may be configured to operate the propulsion systems 160, 170 so as to control the horizontal dimension and movement of the vehicle assembly 120. According to one embodiment of the present invention, the propeller 167 is pitched for clockwise rotation and propeller 177 is pitched for counter-clockwise rotation, thereby providing balancing and stability to the vehicle assembly 120. Movement of the joystick 114 is adapted to vary the current supplied to the motors 162 and 172 so as to create movement in the horizontal direction.

Referring to FIGS. 1, 3, 4, 6, 8, 9, and 10, each of the propulsion systems 140, 150, 160, and 170 have a similar construction. For example, the forward vertical propulsion system 140 and aft vertical propulsion system 150 each have a construction comprising a motor 142, 152 that drives a shaft 143, 153 in clockwise and counterclockwise directions, as is shown in FIGS. 3 and 6. The vertical forward center opening 125 is configured to accept the motor 142 mounted therein. Similarly, the vertical aft center opening 126 is configured to accept the motor 152 mounted therein. Once the motors 142, 152 are disposed in the vertical forward and aft center openings 125, 126, respectively, the shaft 143, 153 of each motor 142, 152, respectively, uses a seal 144, 154 to inhibit water 103 from entering the motor compartment. The end 145, 155 of the shaft 143, 153 may be formed to slide through the cap 146, 156 and to mount a propeller 147, 157 thereon. Under the control of the user 107 by movement of joystick 113 the controller 231 on the circuit board 112 in the control unit 110 will send control signals to the controller 240 on the circuit board 136 in the vehicle assembly 120 so as to vary the speed of rotation and direction of the propellers 147, 157 so as to maneuver the vehicle assembly 120 in the desired vertical direction in the water 103.

Figure 4:
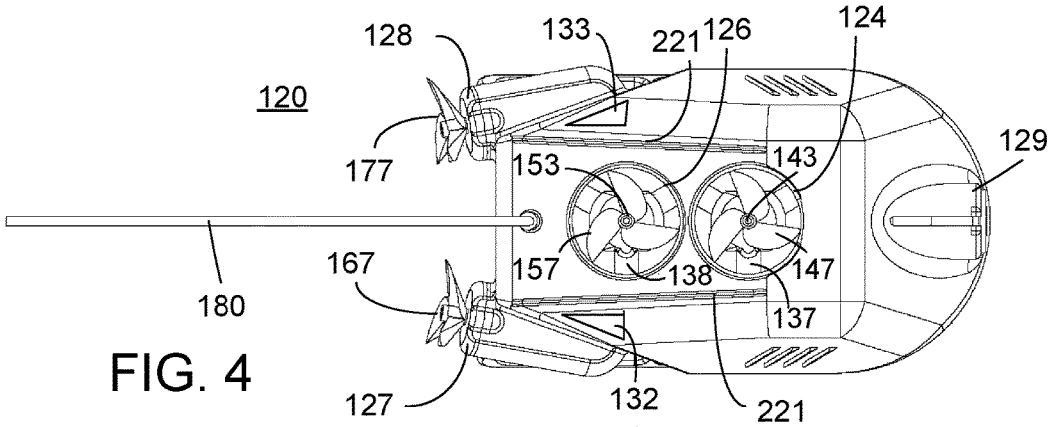
FIG. 4 is a top view illustrating the ROV and system.
Figure 5:
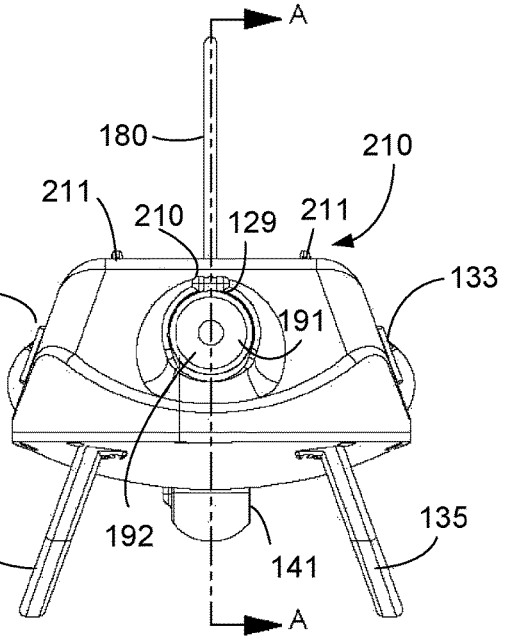
FIG. 5 is a front view illustrating the ROV and system of the present invention.

Similarly, the starboard horizontal propulsion system 160 and port horizontal propulsion system 170 each have a construction comprising a motor 162, 172 that drives a shaft 163, 173 in clockwise and counterclockwise directions, as is shown in FIGS. 3, 4 and 6. The starboard opening 127 is configured to accept the motor 162 mounted therein. Similarly, the port opening 128 is configured to accept the motor 172 mounted therein. Once the motors 162, 172 are disposed in the openings 127, 128 the shaft 163, 173 of each motor 162, 172, respectively, a seal 164, 174 is used to inhibit water 103 from entering the motor compartment. The end 165, 175 of the shaft 163, 173 may be formed to slide through the cap 166, 176 and to mount a propeller 167, 177 thereon. Under the control of the user 107 by movement of joystick 114, the controller 231 on the circuit board 112 in the control unit 110 will send control signals to the controller 240 on the circuit board 136 in the vehicle assembly 120 so as to vary the speed of rotation and direction of the propellers 167, 177 so as to maneuver the vehicle assembly 120 in the desired horizontal direction in the water 103.

Referring to FIG. 7, the circuit diagram 230 illustrates the primary communications between the control unit 110 and the vehicle assembly 120 is described for the ROV and system 100. The control unit 110 has an electronic circuit board 112 with the microcontroller 231 that communicates with the joysticks 113, 114 and the monitor 115. The control unit 110 may be formed with a source of electric power 200 such as the battery 201. The vehicle assembly 120 has an electronic circuit 136 configured with a microcontroller 240 that communicates with the microcontroller 231, the camera assembly 190 including one or more cameras 191, 193, and/or 194, any light 220, and laser 221. Each of the joysticks 113, 114 communicates directional control signals to the motors 142, 152, 162 and 172 via control lines or wires disposed in the cable 180. The cable 180 further contains lines or wires for receiving video signals from the one the camera assembly 190 including one or more cameras 191, 193, and/or 194, any light 220, and laser 221.

In operation, communication from the control unit 110 to the vehicle assembly 120 is through the cable 180 that has both the camera wires for RGB and monochromatic signals the camera assembly 190. For example, images from the camera 191 are transmitted to a monitor 115 typically in color; however, the ROV and system 100 may be configured to switch automatically to monochrome in low light conditions so as to make the images more visible. Similarly, the microprocessor or controller 231 proportionally controls the drive motors giving infinite speed control to the operator for vertical, forward, and backward motion of the vehicle assembly 120.

Referring to FIGS. 1, 2 and 7, the motion of the ROV and system 100 is controlled by joysticks 113, 114 however various inputs may be utilized on the control unit 110 such as, for example, by a series of buttons, accelerometers or similar sensors that can direct the vehicle assembly 120 based on the inclination of the control unit 110, or any other user friendly input design that can be incorporated. Input signals from the user 107 are conveyed to the motors 142, 152, 162 and 172 via the motor control wires so as to operate the horizontal and vertical movement through propellers 147, 157, 167 and 177. In one embodiment, buttons may be used to input desired direction for, for example, straight-forward or backwards and straight-up and down as desired by the input of the user 107. In another embodiment using an accelerometer, the user 107 utilizes and watches monitor 115 and axis of control can be effectuated so that movement of the vehicle assembly 120 can be in all directions. For example, in order to manipulate and move the vehicle assembly 120 straight forward the user 107 tilts the front end of the control unit 110 straight down. If the user 107 desires to turn and move the vehicle assembly 120 to the right the user simply tilts the control unit 110 to the right. In a similar manner, other axis of control can effectuated so that movement of the vehicle assembly 120 in all directions may be accomplished. Use of an accelerometer configured with the control unit advantageously can provide control by feel of the user 107 by shifting the body or the hands holding the control unit 110 that is particularly useful for manipulating the vehicle assembly 120 remotely and underwater 103.

Referring to FIG. 1, the monitor 115 may utilize the cover 117 to protect the screen for transportation as well as a sun visor to help block ambient light when used in the field so as to make it easier to see the images on the screen of the monitor 115. There is also a spooling cradle 116 on, or associated with, the remote controller 110 for coiling the umbilical cable storage and to assist in feeding out the cable as the vehicle assembly 120 is moving away and also for a place to wind up the cable as the vehicle assembly 120 is being retrieved.

As is illustrated in FIG. 2, the ROV and system 100 is shown descending through a hole 101 in the ice 102. According to an exemplary embodiment of the present invention of ice fishing, holes 101 are drilled with a power ice auger (not shown) and the diameter of the ice auger is usually 8 inches so it is easy to pull a good sized fish up out of the water. The vehicle assembly 120 can descend in the water 103 and search for locations 105 where there may be fish 104. This may be accomplished for underwater observation by using the ROV and system 100 in the water 103 in communication with the control unit 110 maneuvering and controlling the motion down through the hole 101 to a level below the ice 102 and then by observing the image on the monitor 115 to maneuver to locate fish 104. The cable 180 is fed out as the vehicle assembly 120 descends and, for recovery, the cable 180 is then used to retrieve the vehicle assembly 120 (e.g. by pulling it in).

According to another embodiment of the present invention, the ROV and system 100 advantageously may form the vehicle assembly 120 with a laser beam assembly or module 210 is located on the upper surface of the upper portion 122 for location information. The laser beam assembly 210 may be supplied with energy from the battery 201 and circuit board assembly 136. Alternatively, a laser beam module 210 may be formed as sealed a module attachment powered by its own energy source 200 (i.e., with its own battery 201) that can be attached to the surface of the upper portion 122. The surface mounted laser 210 directs light upwardly towards the ice 102 so as to identify the location of the vehicle assembly 120 under the ice 102 such as, for example, in order to open a hole 101 at a location 105 of fish 104.

According to another embodiment of the present invention, the ROV and system 100 advantageously may have the vehicle assembly 120 surface coated using a hydrophobic coating. The hydrophobic coating provides a water shedding action advantageously so that, as the vehicle assembly 120 is retrieved and pulled from the water 103, ice does not form on the enclosure. Accordingly, the vehicle assembly 120 will be essentially dry so that ice does not form on the outside surface of the vehicle assembly 120 in freezing ambient conditions often occurring in ice fishing.

According to an embodiment of the present invention, the circuit board assembly 136 with programmable electronics is connected to the battery 201 and is also operably connected to the control unit 110 by the control cable 180 is illustrated in FIG. 7. The circuit board assembly 136 is a unique design for supplying power to the vehicle assembly 120 the ROV and system 100. The controller 231 controls the vehicle assembly 120 the ROV and system 100 by a uni-directional analog simplex signal or a bi-directional serial signal sent from the control unit 110 and received by the controller 240 through the wires in the cable 180. Communications between the controller 231 and controller 240 located on the vehicle assembly 120 of the ROV and system 100 may also be through with fiber optics so as to provide the controls required for the vehicle assembly 120.

According to an embodiment of the present invention, the design has independent control of all four thrusters 140, 150, 160 and 170, as well as the ability to change the program remotely to adjust the output of the thrusters if desired, advantageously to provide improved control of the vehicle assembly 120 the ROV and system 100. Disadvantages of conventional ROV included problems with less than optimal supply of a full range of power to the thrusters and control of the movement of conventional ROV units was difficult and frustrating for the user. Accordingly, the vehicle assembly 120 the ROV and system 100 utilizes two joysticks 113, 114 controlled by the controller 231 (i.e. microprocessor and associated electronics) so as to provide proportional control to the drive motors 142, 152, 162 and 172 thereby providing infinite speed control to the user 107. Joysticks 113, 114 may be configured to control the forward vertical propulsion system 140 and aft vertical propulsion system 150 and starboard horizontal propulsion system 160 and port horizontal propulsion system 170 by mixing these control signals input to the control unit 110. The controller 231 can be formed to identify and operate on the degree that the joysticks 113, 114 are moved (e.g., forward, backward, or to the sides) so as to convert to control signals for full functional directional steering in the vertical and horizontal direction. The controllers 231 and 240 may utilize firmware and/or software located in the programmable circuit can be changed to provide many different operational options including neutral buoyancy and gyroscopic balance.

According to an embodiment of the present invention, the cable 180 contains the very fine control wires that connect the controller 231 of the control unit 110 controller to the circuit board assembly 136 in the vehicle assembly 120. The cable 180 includes wire for power, control of propulsion systems 140, 150, 160, and 170, the camera assembly 190 including one or more cameras 192 194 and/or 195 so as to connect these to the monitor 115 and view the fish 104 and/or location 105 underwater 103, the laser assembly 210, and any lighting or lights 220 including LEDs 221. The camera assembly may be formed from suitable small and simple waterproof video cameras with features such as, for example, digital zooming, low level lighting, video recording, depth and temperature detecting, infra-red, with a light source such as infra-red (IR) or LED lights with on and off control, and other features. The display 115 may be formed from a 3.5 inch screen and backlit and configured to utilize the same features such as, for example, digital zooming, low level lighting, video recording, depth and temperature detecting, IR or LED lights with on and off control, and other features of the camera assembly 190.

According to an advantage of the present invention, the ROV and system 100 may be formed to allow for changing the camera assembly 190 on the vehicle assembly 120 so as to add different camera types for different conditions including an underwater camera a user might already own. Moreover, the ROV and system 100 may use one or more camera assemblies 190 such as the forward camera 190, and upward facing camera 194 and a lower facing camera 195. As discussed herein, the camera assembly 190 may be controlled through wires in the cable 180 connected between the circuit board 112, 136 of the control unit 110 and the vehicle assembly 120, respectively. As discussed herein, lights 220 and LEDs 221 may be utilized in the front of the camera 191 and along the upper surface of the upper portion 122, whereby these lighting modules assist in acquiring a better image on the monitor 115 in murky or dark water such as by using intense light source of the bank of LED lights 211.

While certain configurations of structures have been illustrated for the purposes of presenting the basic structures of the present invention, one of ordinary skill in the art will appreciate that other additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for use in ice fishing where a hole is cut into ice to access fish in water, comprising:

inserting a vehicle assembly system in the hole cut in the ice;

driving the vehicle assembly system vertically in the hole by using a controller for operatively generating counter-rotating forces of a forward vertical propulsion unit and an aft vertical propulsion unit, the vertical driving comprises energizing each of a first drive motor operatively coupled to a first propeller of the forward vertical propulsion unit in a first rotational direction to generate a thrust in a vertical direction, and a second drive motor operatively coupled to a second propeller of the aft vertical propulsion unit in a second rotation to generate a thrust in a vertical direction so as to clear the hole;

driving the vehicle assembly system in a horizontal direction using the controller by operatively generating counter-rotating forces of each of a starboard horizontal propulsion unit and a port horizontal propulsion unit, the horizontal driving comprises energizing each of a third drive motor operatively coupled to a first propeller of the starboard horizontal propulsion unit in a first rotational direction to generate a thrust in a horizontal direction, and a fourth drive motor operatively coupled to a second propeller of the aft vertical propulsion unit in a second rotation to generate a thrust in a horizontal direction, locating fish in the water using a camera in a forward opening of a waterproof enclosure of the vehicle assembly system;

actuating a source of light in a top opening of the waterproof enclosure for locating the vehicle assembly system under the ice, wherein the source of light comprises a green laser of a frequency of about 532 nm;

locating light from locating light emitted from the source of light on a top surface of the ice; and accessing fish through a second hole formed through the ice at the location of the emitted light.

2. The method for ice fishing of claim 1, further comprising the step of: searching for fish with the camera by travelling the vehicle assembly system to various locations in the water;

and transmitting images of fish back to a user of the vehicle assembly system.

* * * * *